US008462092B2

(12) United States Patent
Hsu et al.

(10) Patent No.: US 8,462,092 B2
(45) Date of Patent: Jun. 11, 2013

(54) DISPLAY PANEL HAVING SUB-PIXELS WITH POLARITY ARRANGMENT

(75) Inventors: Li-Chih Hsu, Hsin-Chu (TW); Peng-Bo Xi, Hsin-Chu (TW); Chia-Chiang Hsiao, Hsin-Chu (TW)

(73) Assignee: AU Optronics Corp., Science-Based Industrial Park, Hsin-Chu (TW)

( * ) Notice: Subject to any disclaimer, the term of this patent is extended or adjusted under 35 U.S.C. 154(b) by 454 days.

(21) Appl. No.: 12/830,455

(22) Filed: Jul. 6, 2010

(65) Prior Publication Data

US 2011/0242065 A1 Oct. 6, 2011

(30) Foreign Application Priority Data

Apr. 1, 2010 (TW) ..... 99110124 A

(51) Int. Cl.
*G09G 3/36* (2006.01)

(52) U.S. Cl.
USPC ..... 345/96

(58) Field of Classification Search
USPC ..... 345/87, 92, 96, 209
See application file for complete search history.

(56) References Cited

U.S. PATENT DOCUMENTS

| | | | | |
|---|---|---|---|---|
| 7,088,328 | B2 | 8/2006 | Inada | |
| 2005/0219190 | A1 | 10/2005 | Lee | |
| 2007/0216632 | A1 | 9/2007 | Lee | |
| 2008/0231575 | A1 | 9/2008 | Feng | |
| 2008/0266225 | A1 * | 10/2008 | Kim | 345/88 |
| 2010/0156954 | A1 * | 6/2010 | Kim et al. | 345/690 |

* cited by examiner

*Primary Examiner* — Chanh Nguyen
*Assistant Examiner* — Jonathan Blancha
(74) *Attorney, Agent, or Firm* — Winston Hsu; Scott Margo

(57) ABSTRACT

A display panel includes at least twelve sub-pixels, arranged continuously in a row. In a scanning time of the display panel, sub-pixels respectively disposed at a 2nd, 3rd, 5th, 8th, 10th and 12th column have a first polarity, and sub-pixels respectively disposed at a 1st, 4th, 6th, 7th, 9th and 11th column have a second polarity. The first polarity is opposite to the second polarity.

13 Claims, 13 Drawing Sheets

DISPLAY PANEL HAVING SUB-PIXELS WITH POLARITY ARRANGMENT

BACKGROUND OF THE INVENTION

1. Field of the Invention

The present invention relates to a display panel, and more particularly, to a display panel having sub-pixels with a specific polarity arrangement.

2. Description of the Prior Art

In general, liquid crystal displays have been widely applied to various kinds of portable information products, such as notebook and personal digital assistant (PDA), in the market, because of having the advantages of light weight, low power consumption and low radiation. When liquid crystal in the liquid crystal display is fixed at an angle too long during driving the liquid crystal display, the liquid crystal has permanent deformation, and a frame displayed by the liquid crystal display cannot change. In order to avoid reducing the display quality of the liquid crystal display, a polarity inversion driving method is generally used in the liquid crystal display.

The conventional polarity inversion driving method can be divided into a frame inversion, a row inversion, a column inversion, and a dot inversion. Referring to FIG. 1 is a schematic diagram illustrating a polarity arrangement of sub-pixels in the liquid crystal display driven by a column inversion driving method according to the prior art. As shown in FIG. 1, the liquid crystal display 10 of the prior art includes a plurality of sub-pixels 12, arranged in a matrix formation, and the polarity arrangement of the sub-pixels disposed in the same row is that one positive polarity and one negative polarity respectively arranged in turn, and the sub-pixels disposed in the same column have the same polarity. In addition, the sub-pixels in each column respectively are red (R) sub-pixels, green (G) sub-pixels, and blue (B) sub-pixels in turn, and each red sub-pixel, each green sub-pixel adjacent to the red sub-pixel and each blue sub-pixel adjacent to the green sub-pixel constitute a pixel 18. In a next frame, a polarity of each sub-pixel 12 is changed into an opposite polarity, i.e. the original positive polarity is changed into the negative polarity, and the negative polarity is changed into the positive polarity. Accordingly, the liquid crystal can be avoided having permanent deformation due to fixing at an angle too long.

However, during testing the liquid crystal display, the liquid crystal display turns off a part of pixels so as to display a frame with a bright column and a dark column arranged sequentially in a row direction, and the frame shows white image. In this driving method, the red sub-pixels and the blue sub-pixels, which are turned on, disposed in a first row have the positive polarity, and the green sub-pixels, which are turned on, disposed in the first row have the negative polarity. Furthermore, the polarity of each sub-pixel is determined by comparing the voltage of the pixel electrode of each sub-pixel with a common voltage. For this reason, when the voltage of the pixel electrode of each sub-pixel is higher than the common voltage, the polarity of the sub-pixel is the positive polarity, and the voltage of the pixel electrode is at a high level. Otherwise, the polarity of each sub-pixel is the negative polarity, and the voltage of the pixel electrode is at a low level. When the number of the sub-pixels having the positive polarity is larger than the number of the sub-pixels having the negative polarity, i.e. the pixel electrodes of the major sub-pixels have the voltage at the high level, the value of the common voltage is easily affected by the voltage of the pixel electrode to be shifted toward the voltage at the high level. Thus, a voltage difference for driving the red sub-pixels and the blue sub-pixels is reduced, and a voltage difference for driving the green sub-pixels is increased, which result in a gray scale displayed by the green sub-pixels being higher than gray scales displayed by the red sub-pixels and the blue sub-pixels. For this reason, the liquid crystal display easily generates a greenish frame during testing.

In order to avoid generating greenish frame during testing the liquid crystal display, a method of using inverters to change the polarity arrangement of the sub-pixels is disclosed. Refer to FIG. 2. FIG. 2 is a schematic diagram illustrating a polarity arrangement of the liquid crystal display panel using inverters to change the polarities of the sub-pixels according to the prior art. As shown in FIG. 2, a data-line driving circuit 22 of the liquid crystal display panel 20 includes an inverter 24, a first driving circuit 26 and a second driving circuit 28. An end of the inverter 24 is coupled to the first driving circuit 26, and the other end of the inverter 24 is coupled to the second driving circuit 28. The inverter 24 is used to invert the polarities of data signals inputted into the first driving circuit 26 and the data signals inputted into the second driving circuit 28. Accordingly, in the same row, the red sub-pixel 30 in the first column and the red sub-pixel 30 in the seventh column have the polarities opposite to each other. Similarly, the green sub-pixel 32 in the second column and the green sub-pixel 32 in the eighth column have the polarities opposite to each other, and the blue sub-pixel 34 in the third column and the blue sub-pixel 34 in the ninth column have the polarities opposite to each other. Therefore, in all sub-pixels that are turned on, the number of the sub-pixels having the positive polarity is the same as the number of the sub-pixels having the negative polarity, and the common voltage does not shift.

Nevertheless, for changing the polarity of the sub-pixel, the liquid crystal display panel of the prior art should divide the pixel region into two parts. One is connected to a first driving circuit, and the other one is connected to a second driving circuit. An inverter should be coupled to the first driving circuit and the second driving circuit, so that the polarity provided by the first driving circuit is opposite to the polarity provided by the second driving circuit. Accordingly, since the inverter should be extra added into the liquid crystal display panel, the cost of the liquid crystal display panel is increased, and the complexity of the data driving circuit is also increased. Besides, a driving chip for controlling the liquid crystal display panel already has the inverter, and is disposed outside the liquid crystal display panel. Thus, the liquid crystal display panel added with the inverter further limits the design of the driving chip.

SUMMARY OF THE INVENTION

It is one of the objectives of the present invention to provide a display panel having a sub-pixel unit with a specific polarity arrangement to solve the above-mentioned problem in the prior art.

The present invention provides a display panel, which comprises a plurality of first gate lines, a plurality of data lines, and at least six first pixels, respectively defined by any two of the adjacent first gate lines and any two of the adjacent data lines. The first gate lines comprise a 1st first gate line, and a 2nd first gate line, and the 1st first gate line and the 2nd first gate line are arranged sequentially in a first direction. The data lines comprises a 1st data line, a 2nd data line, a 3rd data line, a 4th data line, a 5th data line, a 6th data line, and a 7th data line, arranged sequentially in a second direction, and the second direction intersects the first direction. Each first pixel comprises two first sub-pixels, and the first sub-pixels are arranged in a 1st row. Each first sub-pixel comprises a first switching element. Gate electrode of the first switching element respectively disposed at the 1st row and a 2nd column, a 4th column, a 5th column, a 7th column, a 10th column and an 11th column are coupled to the 1st first gate line. Gate electrode of the first switching element respectively disposed at the 1st row and a 1st column, a 3rd column, a 6th column, an 8th column, a 9th column and a 12th column are coupled to the 2nd first gate line. A source electrode of the first switching element disposed at the 1st row and the 2nd column is coupled to the 1st data line. Source electrode of the first switching element disposed at the 1st row and the 1st column and the 4th column are coupled to the 2nd data line. Source electrode of the first switching element disposed at the 1st row and the 3rd column and the 5th column are coupled to the 3rd data line. Source electrode of the first switching element disposed at the 1st row and the 6th column and the 7th column are coupled to the 4th data line. Source electrode of the first switching element disposed at the 1st row and the 8th column and the 10th column are coupled to the 5th data line. Source electrode of the first switching element disposed at the 1st row and the 9th column and the 11th column are coupled to the 6th data line. Source electrode of the first switching element disposed at the 1st row and the 12th column is coupled to the 7th data line.

The present invention further provides a display panel, which comprises at least twelve first sub-pixels arranged continuously in a 1st row. In a first scanning time of the display panel, the first sub-pixels disposed at the 1st row and the 2nd column, the 3rd column, the 5th column, the 8th column, the 10 column and the 12 column have a first polarity, and the first sub-pixels disposed at the 1st row and the 1st column, the 4th column, the 6th column, the 7th column, the 9 column and the 11 column have a second polarity. The first polarity is opposite to the second polarity.

The present invention provides the above-mentioned electrical connection to electrically connect the switching elements respectively to the corresponding first gate lines and the data lines, so that the sub-pixel unit can have the above-mentioned polarity arrangement. Accordingly, the display panel can have the balance polarity during testing so as to avoid failure resulted from the greenish image or color shift.

These and other objectives of the present invention will no doubt become obvious to those of ordinary skill in the art after reading the following detailed description of the preferred embodiment that is illustrated in the various figures and drawings.

DETAILED DESCRIPTION

To provide a better understanding of the present invention, preferred embodiments will be detailed as follows. The preferred embodiments of the present invention are illustrated in the accompanying drawings with numbered elements to elaborate the contents and effects to be achieved.

Figure 1:
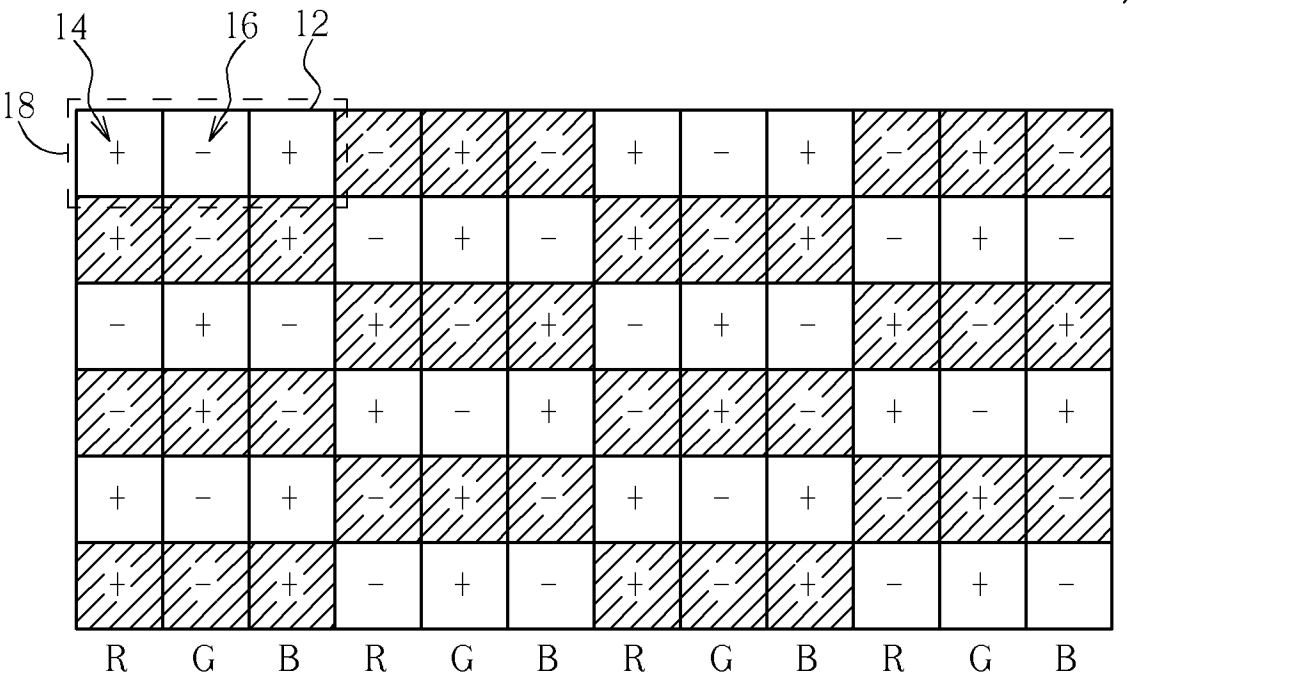
FIG. 1 PRIOR ART
FIG. 1 is a schematic diagram illustrating a polarity arrangement of sub-pixels in the liquid crystal display driven by a column inversion driving method according to the prior art.
Figure 2:
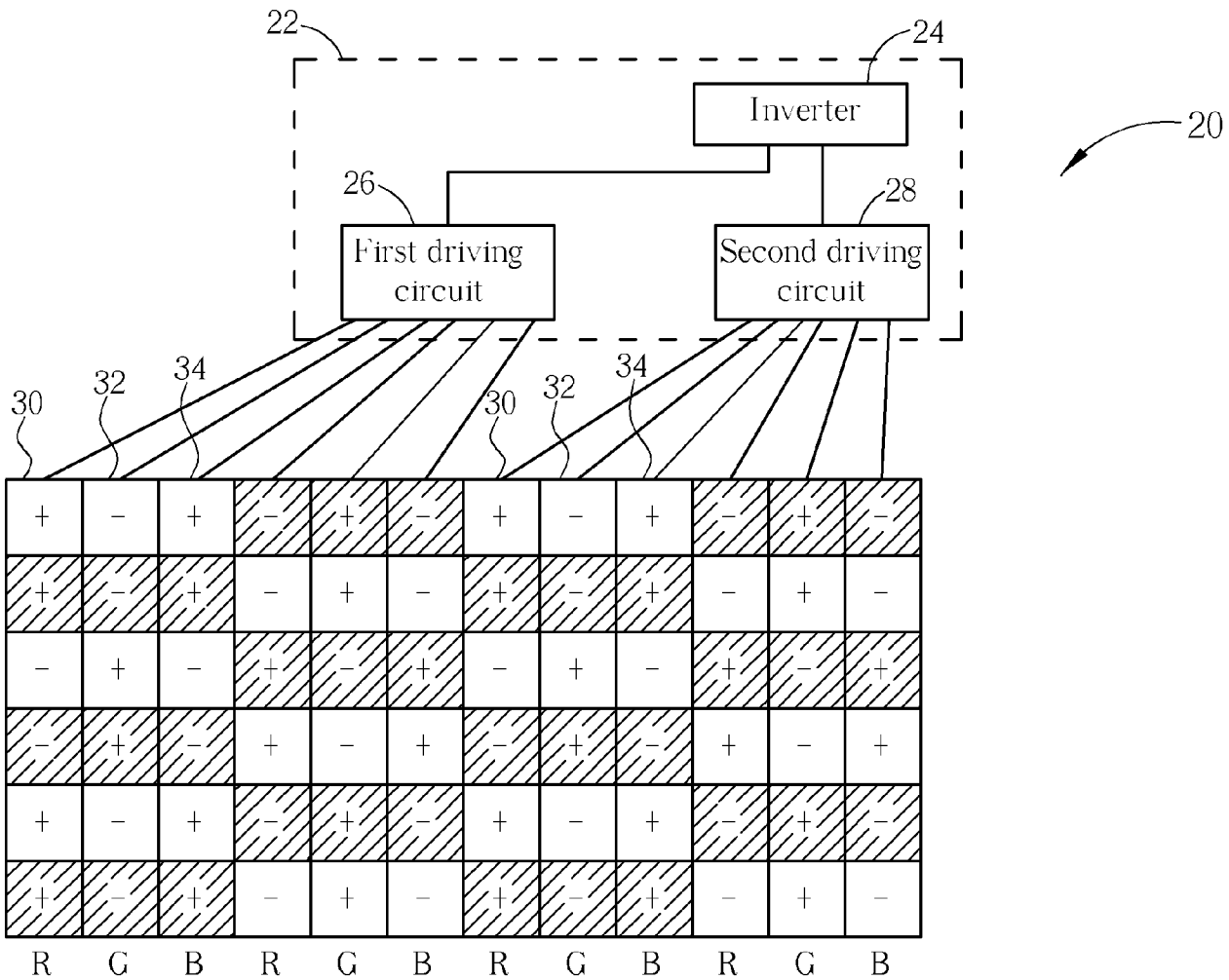
FIG. 2 PRIOR ART
FIG. 2 is a schematic diagram illustrating a polarity arrangement of the liquid crystal display panel using inverters to change the polarities of the sub-pixels according to the prior art.
Figure 3:
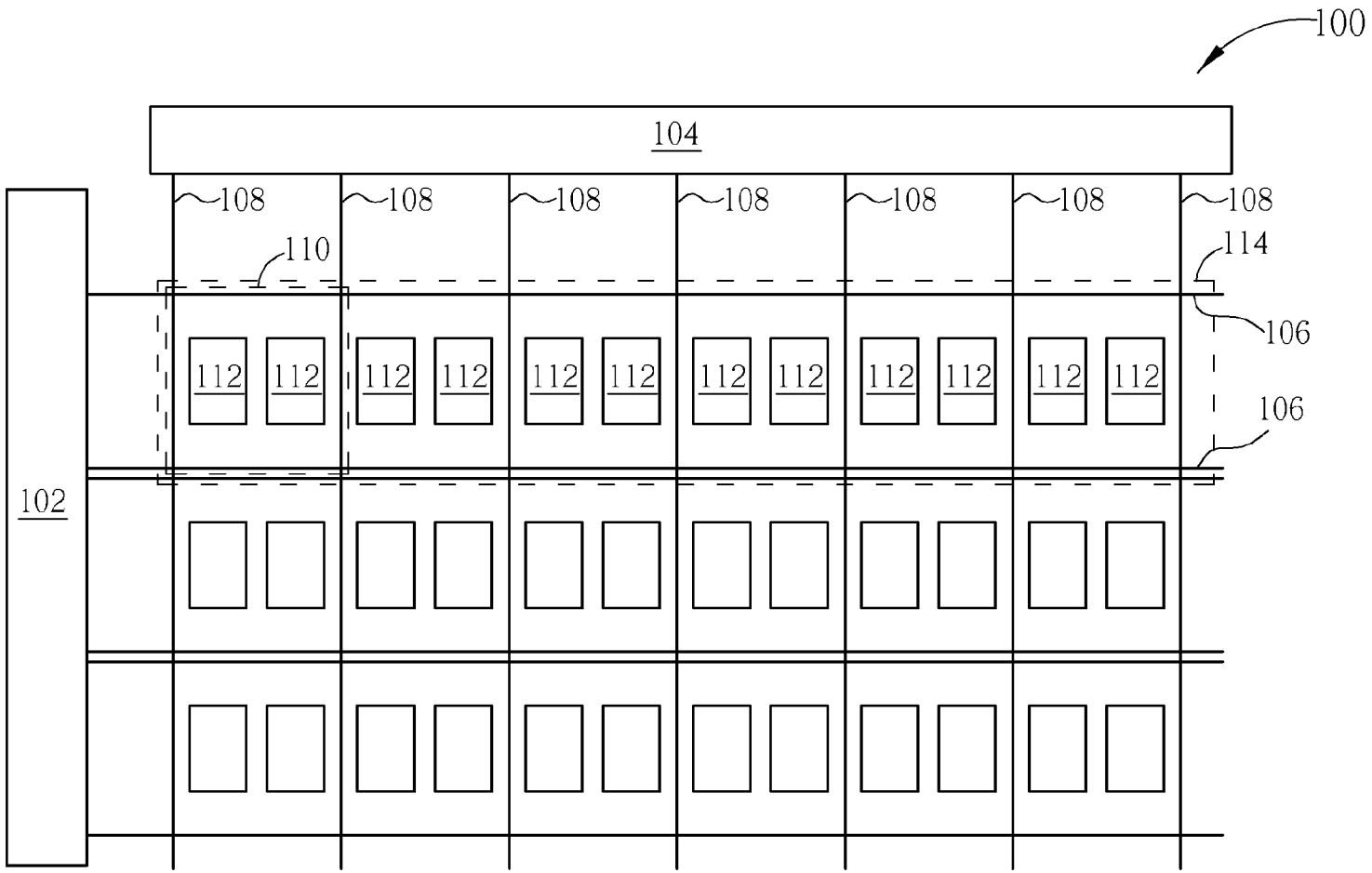
FIG. 3 is a schematic diagram illustrating a display panel in accordance with a first embodiment of the present invention.

Referring to FIG. 3 is a schematic diagram illustrating a display panel in accordance with a first embodiment of the present invention. As shown in FIG. 3, the display panel 100 of this embodiment includes a gate-line driving circuit 102, at least one data-line driving circuit 104, a plurality of gate lines 106, a plurality of data lines 108 and a plurality of first pixel 110. Each gate line 106 is coupled to the gate-line driving circuit 102, and each data line 108 is coupled to the data-line driving circuit 104, but is not limited to this connection. Preferably, the odd gate lines 106 are coupled to a gate-line driving circuit, and the even gate lines 106 are coupled to another gate-line driving circuit. The present invention is not limited to this. In other embodiments, the odd gate lines 106 and the even gate lines 106 can be coupled to the same gate-line driving circuit. In addition, the data-line driving circuit 104 in this embodiment does not have an inverter, and does not need to provide a function of inverting the provided data signals. The present invention is not limited to only have a data-line driving circuit and may include a plurality of data-line driving circuits. Furthermore, two gate lines 106 constitute a gate-line set, and each gate-line set and any two of the data lines 108 define each pixel 110. This embodiment takes each pixel 110 respectively including two sub-pixels 112 and the sub-pixels 112 at a row and twelve columns regarded as a sub-pixel unit 114 as an example, but the present invention is not limited to this embodiment. In other embodiments, each pixel may respectively include one sub-pixel, two sub-pixels, three sub-pixels, four sub-pixels, five sub-pixels, six sub-pixels, and each twelve sub-pixels at a row and twelve columns is regarded as a sub-pixel unit. Or, each pixel may include at least three sub-pixels, and each twelve sub-pixels at a row and twelve columns is regarded as a sub-pixel unit.

When the display panel 100 displays a frame, in a first scanning time of the display panel 100, the sub-pixels 112 disposed at a 1st row and a 2nd column, a 3rd column, a 5th column, an 8th column, a 10th column, and a 12th column are turned on by the gate-line driving circuit 102, and receive data signals with a first polarity from the data-line driving circuit 104. Accordingly, the sub-pixels 112 disposed at the 1st row and the 2nd column, the 3rd column, the 5th column, the 8th column, the 10th column, and the 12th column have the first polarity. Similarly, the sub-pixels 112 disposed at the 1st row and a 1st column, a 4th column, a 6th column, a 7th column, a 9th column, and an 11th column are simultaneously turned on by the gate-line driving circuit 102, and receive data signals with a second polarity from the data-line driving circuit 104. Accordingly, the sub-pixels 112 disposed at the 1st row and the 1st column, the 4th column, the 6th column, the 7th column, the 9th column, and the 11th column have the second polarity, and the first polarity is opposite to the second polarity. In this embodiment, the first polarity is positive polarity (+), and the second polarity is negative polarity (−). The present invention is not limited to this, and vice versa. A polarity arrangement of the sub-pixel unit 114 arranged sequentially from right to left in this embodiment is therefore "−++−+−−+−+−+".

Figure 4:
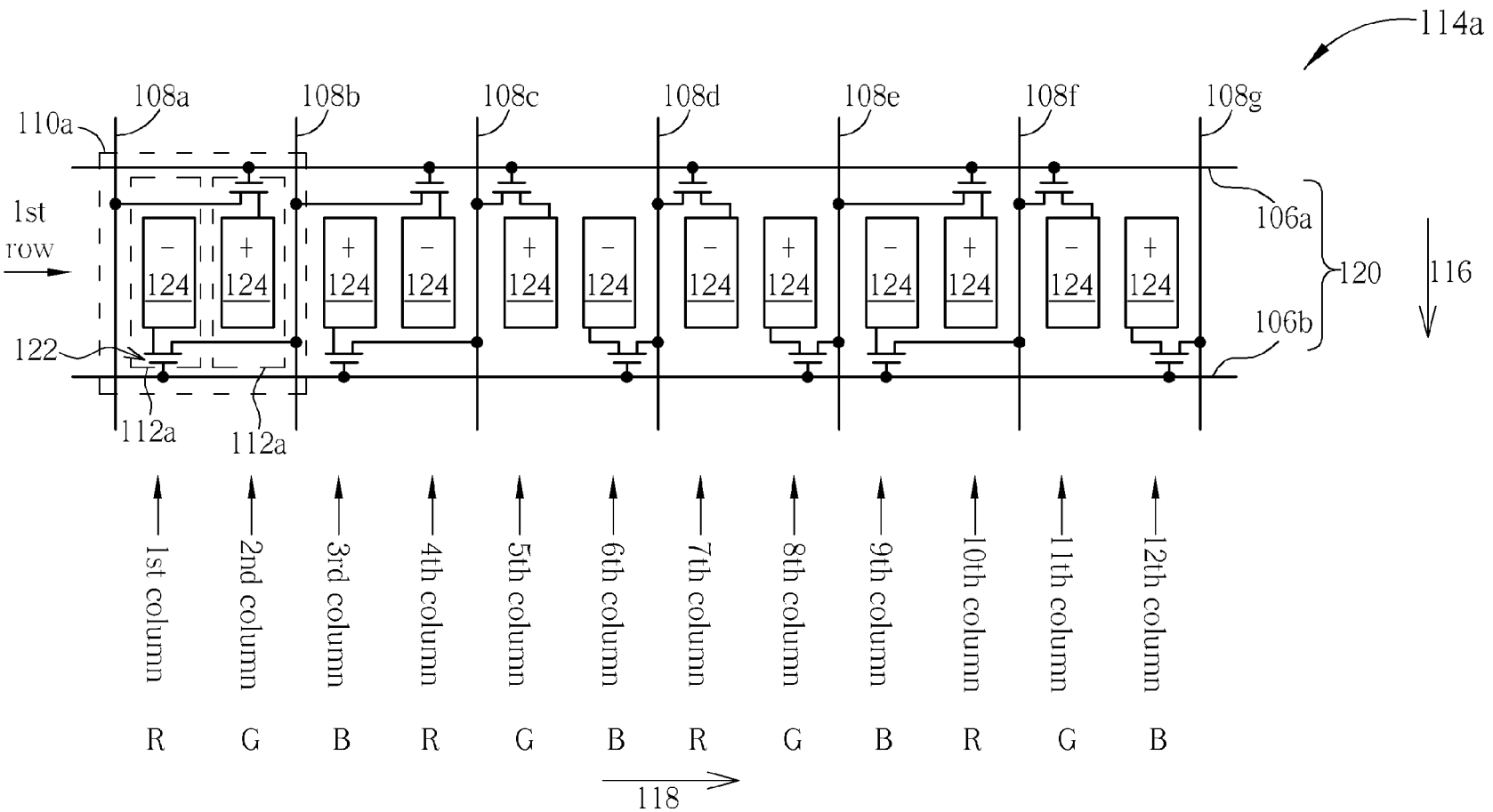
FIG. 4 is a schematic diagram illustrating a first sub-pixel unit of the display panel according to the first embodiment of the present invention.

In order to detail the connection of the sub-pixels in a sub-pixel unit, refer to FIG. 4, and refer to FIG. 3 again. FIG. 4 is a schematic diagram illustrating a first sub-pixel unit of the display panel according to the first embodiment of the present invention. As shown in FIG. 4, only a sub-pixel unit 114*a* is shown in the display panel 100; that is only two gate lines 106, seven data lines 108 and twelve sub-pixels 112 are illustrated, but the number of the gate line 106, data line 108 and the sub-pixel 112 in this embodiment is not limited to the above-mentioned number. In this embodiment, the gate lines 106 includes at least one 1st first gate line 106*a* and at least one 2nd first gate line 106*b*, arranged sequentially in a first direction 116. The data lines 108 includes a 1st data line 108*a*, a 2nd data line 108*b*, a 3rd data line 108*c*, a 4th data line 108*d*, a 5th data line 108*e*, a 6th data line 108*f*, and a 7th data line 108*g*, and the 1st data line 108*a*, the 2nd data line 108*b*, the 3rd data line 108*c*, the 4th data line 108*d*, the 5th data line 108*e*, the 6th data line 108*f*, and the 7th data line 108*g* are arranged sequentially in a second direction 118. The second direction 118 intersects the first direction 116. In addition, the 1st first gate line 106*a* and the 2nd first gate line 106*b* adjacent to each other constitute a first gate-line set 120, and the first gate-line set 120 and the 1st through 7th data lines 108*a*, 108*b*, 108*c*, 108*d*, 108*e*, 108*f*, 108*g* define six first pixels 110*a*. Two adjacent first sub-pixels 112*a* are defined as a first pixel 110*a* so as to constitute a first sub-pixel unit 114*a*, and the first sub-pixel unit 114*a* has twelve first sub-pixels 112*a* that are arranged continuously in a 1st row. In addition, each first sub-pixel 112*a* includes a first switching element 122 and a first pixel electrode 124, and a drain electrode of each first switching element 122 is respectively coupled to each first pixel electrode 124.

In this embodiment, the connection structure of the first sub-pixels 112*a* of the first sub-pixel unit 114*a* in the following description is only an example of the first sub-pixel unit 114*a* having a polarity arrangement of "−++−+−−+−+−+", but the present invention is not limited to this example. In other examples, the connection structure of each first sub-pixel 112*a* of the first sub-pixel unit 114*a* can be correspondingly adjusted according to the number of the first sub-pixel 112*a* included by each first pixel 110*a*, such as each first pixel 110*a* including three first sub-pixels 112*a*, or the arranged shape of each first sub-pixel 112*a*, such as triangle arrangement. The first sub-pixel unit 114*a* of this embodiment mainly has the polarity arrangement of "−++−+−−+−+−+".

In the first sub-pixel unit 114*a*, gate electrodes of the first switching elements 122 respectively disposed at the 1st row and the 2nd column, the 4th column, the 5th column, the 7th column, the 10th column and the 11th column are coupled to the 1st first gate line 106*a*; gate electrodes of the first switching elements 122 respectively disposed at the 1st row and the 1st column, the 3rd column, the 6th column, the 8th column, the 9th column and the 12th column are coupled to the 2nd first gate line 106*b*; a source electrode of the first switching element 122 disposed at the 1st row and the 2nd column is coupled to the 1st data line 108*a*; source electrodes of the first switching elements 122 disposed at the 1st row and the 1st column and the 4th column are coupled to the 2nd data line 108*b*; source electrodes of the first switching elements 122 disposed at the 1st row and the 3rd column and the 5th column are coupled to the 3rd data line 108*c*; source electrodes of the first switching elements 122 disposed at the 1st row and the 6th column and the 7th column are coupled to the 4th data line 108*d*; source electrodes of the first switching elements 122 disposed at the 1st row and the 8th column and the 10th column are coupled to the 5th data line 108*e*; source electrodes of the first switching elements 122 disposed at the 1st row and the 9th column and the 11th column are coupled to the 6th data line 108*f*; a source electrode of the first switching element 122 disposed at the 1st row and the 12th column is coupled to the 7th data line 108*g*.

In the first scanning time of the display panel 100, the gate-line driving circuit 102 of this embodiment provides a first scanning signal to the 1st first gate line 106*a* and the 2nd first gate line 106*b* so as to turn on each first switching element 122, and the data-line driving circuit 104 provides data signals with the first polarity to the 1st data line 108*a*, the 3rd data line 108*c*, the 5th data line 108*e* and the 7th data line 108*g* and provides data signals with the second polarity to the 2nd data line 108*b*, the 4th data line 108*d* and 6th data line 108*f*. That is, the display panel 100 of this embodiment uses a column inversion driving method to provide the data signals with the first polarity to the odd data lines 108 and to provide the data signals with the second polarity to the even data lines 108. Thus, in the first scanning time, the polarity arrangement of the first sub-pixel unit 114*a* from left to right is "−++−+−−+−+−+". Furthermore, according to the above-mentioned driving method, the first sub-pixels 112*a* disposed in different columns can share a same data line 108, i.e. the display panel of this embodiment uses a driving method of a half source driver (HSD) structure.

Figure 5:
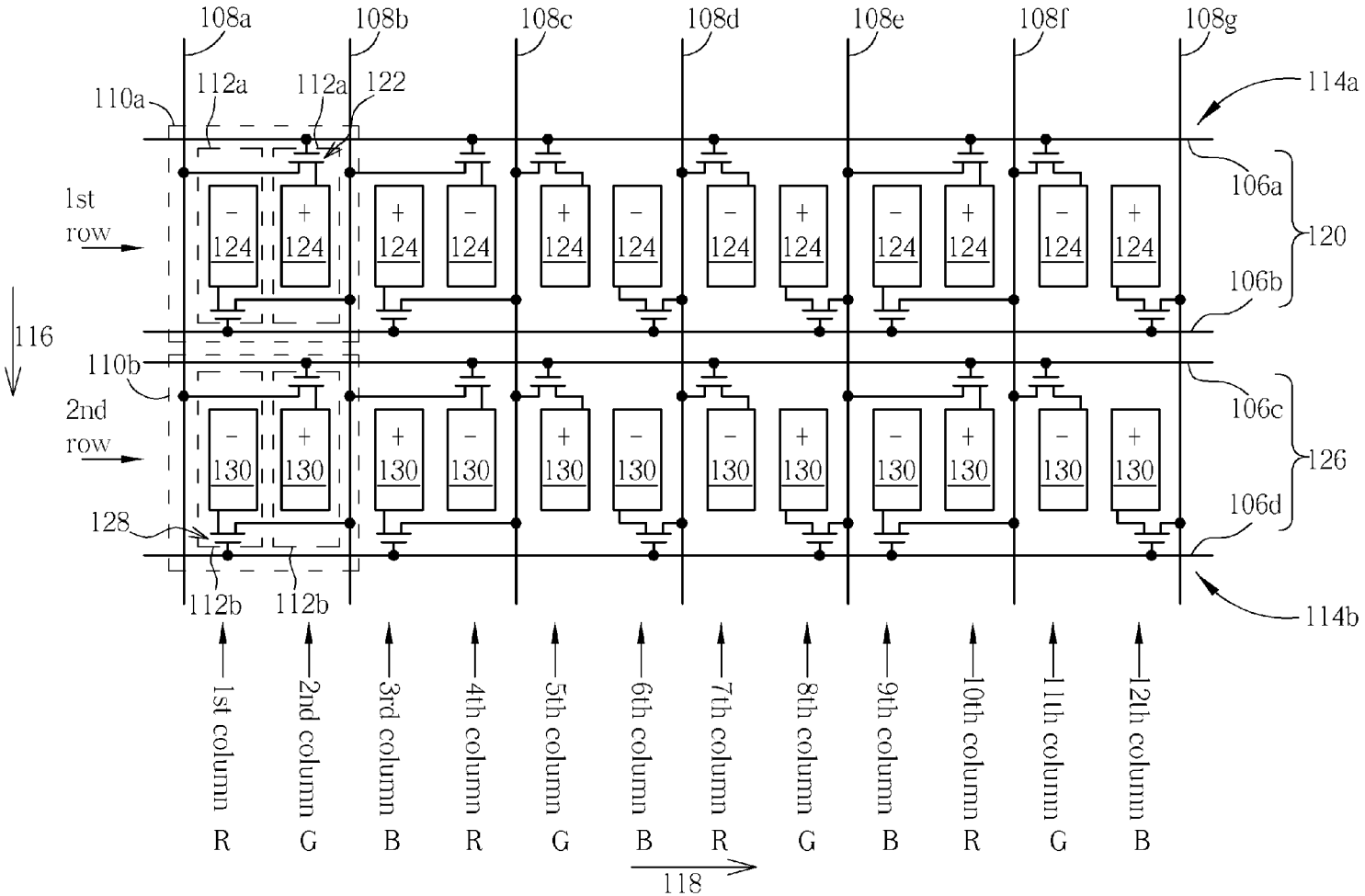
FIG. 5 is a schematic diagram illustrating the display panel with the repeated first sub-pixel units in different rows according to the first embodiment of the present invention.

The present invention is not limited to only have a first sub-pixel unit with the above-mentioned polarity arrangement, and the present invention also can repeat and extend the first sub-pixel unit in the 1st row, or repeat the first sub-pixel unit in different columns. Referring to FIG. 5, and refer to FIG. 3 again. FIG. 5 is a schematic diagram illustrating the display panel with the repeated first sub-pixel units in different rows according to the first embodiment of the present invention. As shown in FIG. 5, the gate lines 106 further includes at least one 1st second gate line 106*c* and at least one 2nd second gate line 106*d*, arranged sequentially in the first direction 116, and the 1st second gate line 106*c* and the 2nd second gate line 106*d* adjacent to each other constitute a second gate-line set 126. Each first gate-line set 120 and each second gate-line set are respectively arranged sequentially in the first direction 116. The 1st second gate line 106*c* and the 2nd second gate line 106*d* and the 1st through 7th data lines 108*a*, 108*b*, 108*c*, 108*d*, 108*e*, 108*f*, 108*g* define six second pixels 110*b*, and the second pixels 110*b* and the first pixels 110*a* are respectively disposed in different rows. Two adjacent second sub-pixels 112*b* are defined as a second pixel

110*b* so as to constitute a second sub-pixel unit 114*b*, and the second sub-pixel unit 114*b* has twelve second sub-pixels 112*b*. The twelve second sub-pixels are continuously arranged in a 2nd row adjacent to the 1st row. Each second sub-pixel 112*b* includes a second switching element 128 and a second pixel electrode 130, and a drain electrode of each second switching element 128 is respectively coupled to each second pixel electrode 130.

The first sub-pixel unit 114*a* and the second sub-pixel unit 114*b* of this embodiment are driven in different scanning times. In a second scanning time of the display panel 100, the second switching elements 128 disposed at the 2nd row and the 2nd column, the 3rd column, the 5th column, the 8th column, the 10 column and the 12 column are turned on, and are respectively received data signals with a third polarity, so that the second sub-pixels 112*b* disposed in the 2nd row and in the 2nd column, the 3rd column, the 5th column, the 8th column, the 10 column and the 12 column have the third polarity. Simultaneously, the second switching elements 128 disposed at the 2nd row and the 1st column, the 4th column, the 6th column, the 7th column, the 9 column and the 11 column are also turned on, and are respectively received data signals with a fourth polarity, so that the second sub-pixels disposed at the 2nd row and the 1st column, the 4th column, the 6th column, the 7th column, the 9 column and the 11 column have the fourth polarity. The third polarity is opposite to the fourth polarity; the third polarity is the same as the second polarity; and the fourth polarity is the same as the first polarity. As we can see from the above, a polarity arrangement of the second sub-pixel unit 114*b* disposed in the 2nd row is the same as the polarity arrangement of the first sub-pixel unit 114*a* disposed in the 1st row. It should be noted that the first sub-pixel unit 114*a* and the second sub-pixel unit 114*b* in different rows also can be selectively driven in the same scanning time, and the polarity arrangements of the above-mentioned first sub-pixel unit 114*a* and the second sub-pixel unit 114*b* in different rows should be also obey the above-mentioned rule.

In this embodiment, the connection of the second sub-pixels 112*b* of the second sub-pixel unit 114*b* in the following description is only an example of the second sub-pixel unit 114*b* having "−++−+−−+−+−+", and the present invention is not limited to this embodiment. In other examples, the connection structure of each second sub-pixel 112*b* of the second sub-pixel unit 114*b* can be correspondingly adjusted according to the number of the second sub-pixel 112*b* included by each second pixel 110*a* or the arranged shape of each second sub-pixel 112*b*. The second sub-pixel unit 114*b* of this embodiment mainly has the polarity arrangement of "−++−+−−+−+−+".

In the second sub-pixel unit 114*b*, gate electrodes of the second switching elements 128 respectively disposed at the 2nd row and the 2nd column, the 4th column, the 5th column, the 7th column, the 10th column and the 11th column are coupled to the 1st second gate line 106*c*; gate electrodes of the second switching elements 128 respectively disposed at the 2nd row and the 1st column, the 3rd column, the 6th column, the 8th column, the 9th column and the 12th column are coupled to the 2nd second gate line 106*d*; a source electrode of the second switching element 128 disposed at the 2nd row and the 2nd column is coupled to the 1st data line 108*a*; source electrodes of the second switching elements 128 disposed at the 2nd row and the 1st column and the 4th column are coupled to the 2nd data line 108*b*; source electrodes of the second switching elements 128 disposed at the 2nd row and the 3rd column and the 5th column are coupled to the 3rd data line 108*c*; source electrodes of the second switching elements 128 disposed at the 2nd row and the 6th column and the 7th column are coupled to the 4th data line 108*d*; source electrodes of the second switching elements 128 disposed at the 2nd row and the 8th column and the 10th column are coupled to the 5th data line 108*e*; source electrodes of the second switching elements 128 disposed at the 2nd row and the 9th column and the 11th column are coupled to the 6th data line 108*f*; a source electrode of the second switching element 128 disposed at the 2nd row and the 12th column is coupled to the 7th data line 108*g*. In the second scanning time of the display panel 100, the gate-line driving circuit 102 of this embodiment provides a second scanning signal to the 1st second gate line 106*c* and the 2nd second gate line 106*d* so as to turn on each second switching element 128, and the data-line driving circuit 104 provides the data signals with the third polarity to the 1st data line 108*a*, the 3rd data line 108*c*, the 5th data line 108*e* and the 7th data line 108*g*, and provides the data signals with the fourth polarity to the 2nd data line 108*b*, the 4th data line 108*d* and 6th data line 108*f*. Thus, the polarity arrangement of the second sub-pixel unit 114*b* from left to right is "−++−+−−+−+−+".

In addition, the first sub-pixels 112*a* and the second sub-pixels 112*b* respectively disposed in the 1st column, the 4th column, the 7th column and the 10th column display a first color; the first sub-pixels 112*a* and the second sub-pixels 112*b* respectively disposed in the 2nd column, the 5th column, the 8th column and the 11th column display a second color; and the first sub-pixels 112*a* and the second sub-pixels 112*b* respectively disposed in the 3rd column, the 6th column, the 9th column and the 12th column display a third color. In this embodiment, the first color is red; the second color is green; and the third color is blue, so that the first color, the second color and the third color can be mixed into white. In other words, the sub-pixels 112 disposed in the same column have the same color, and the colors displayed in each column respectively are red, green and blue sequentially from left to right. The present invention is not limited to this, and the first color, the second color and the third color can be exchanged, or can be respectively yellow, magenta and cyan.

Figure 6:
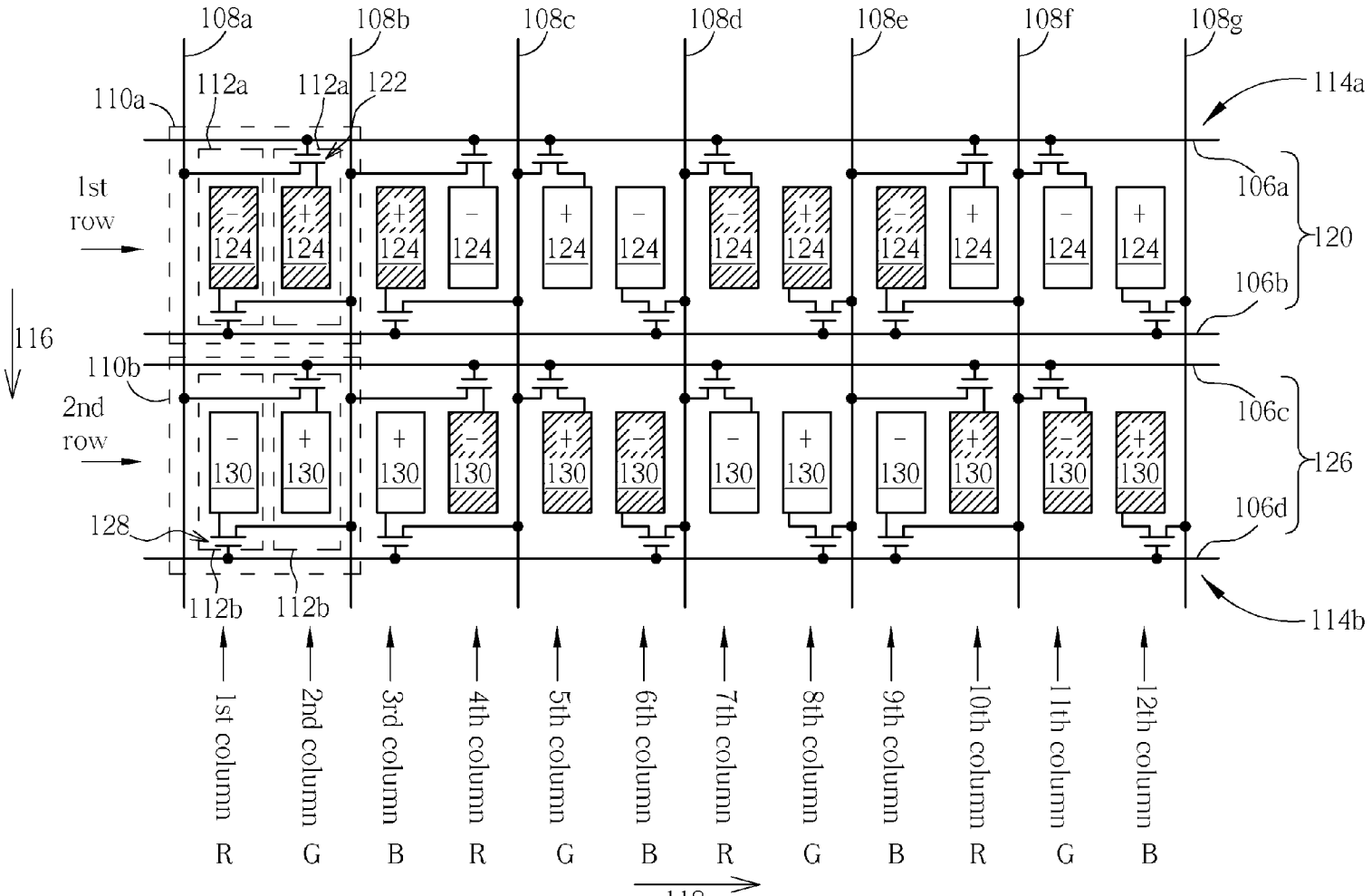
FIG. 6 is a schematic diagram illustrating the polarity arrangement of the display panel during testing according to the first embodiment of the present invention.

For clarify the display panel of this embodiment having a balance polarity during testing, refer to FIG. 6, which is a schematic diagram illustrating the polarity arrangement of the display panel during testing according to the first embodiment of the present invention. As shown in FIG. 6, when the display panel 100 is tested, in the first scanning time, the data-line driving circuit 104 still provides the data signals with the first polarity to the 1st data line 108*a*, the 3rd data line 108*c*, the 5th data line 108*e* and the 7th data line 108*g*, and provides the data signals with the second polarity to the 2nd data line 108*b*, the 4th data line 108*d* and the 6th data line 108*f*. Furthermore, the first sub-pixels 112*a* disposed in the 1st column, the 2nd column, the 3rd column, the 7th column, the 8th column and the 9th column are turned off, and display no color. The first sub-pixels 112*a* disposed in the 4th column, the 5th column, the 6th column, the 10th column, the 11th column and the 12th column are turned on, and display corresponding colors. Thus, the first sub-pixels 112*a* disposed in the 4th column, the 6th column, the 11th column have the first polarity, and the first sub-pixels 112*a* disposed in the 5th column, the 10th column and the 12th column have the second polarity. In the second scanning time, the data-line driving circuit 104 provides the data signals with the third polarity to the 1st data line 108*a*, the 3rd data line 108*c*, the 5th data line 108*e* and the 7th data line 108*g*, and provides the data signals with the fourth polarity to the 2nd data line 108*b*, the 4th data line 108*d* and the 6th data line 108*f*. Furthermore, the second sub-pixels 112*b* disposed in the 4th column, the 5th column, the 6th column, the 10th column, the 11th column and the 12th column are turned off, and the second sub-pixels 112*b* disposed in the 1st column, the 2nd column, the 3rd column, the 7th column, the 8th column and the 9th column are turned on. Thus, the second sub-pixels 112*b* disposed in the 2nd column, the 3rd column, the 8th column have the third polarity, and the second sub-pixels 112*b* disposed in the 1st column, the 7th column and the 9th column have the fourth polarity. As mentioned above, the number of the first sub-pixels 112*a* with the first polarity is the same as the number of the first sub-pixels 112*a* with the second polarity, and the number of the second sub-pixels 112*b* with the third polarity is also the same as that of the second sub-pixels 112*b* with the fourth polarity. Therefore, the display panel 100 of this embodiment can have the balance polarity during testing, and the frame with greenish image or color shift can be avoided.

It is worthy to note that the first sub-pixels of the first sub-pixel unit in this embodiment can have the balance polarity during testing because of having the above-mentioned polarity arrangement. For this reason, the frame with greenish image or color shift would not be generated so as to avoid failure during testing. Furthermore, this embodiment provides an electrical connection structure of the first switching elements in the first sub-pixel unit being electrically connected to the corresponding first gate lines and data lines, so that the data-line driving circuit of the display panel does not need any inverter. The display panel can only use the column inversion driving method the in the prior art to have a function of the balance polarity.

The display panel of the present invention is not limited to the above-mentioned embodiment. The following description continues to detail the other embodiments or modifications, and in order to simplify and show the difference between the other embodiments or modifications and the above-mentioned embodiment, the same numerals denote the same components in the following description, and the same parts are not detailed redundantly.

Figure 7:
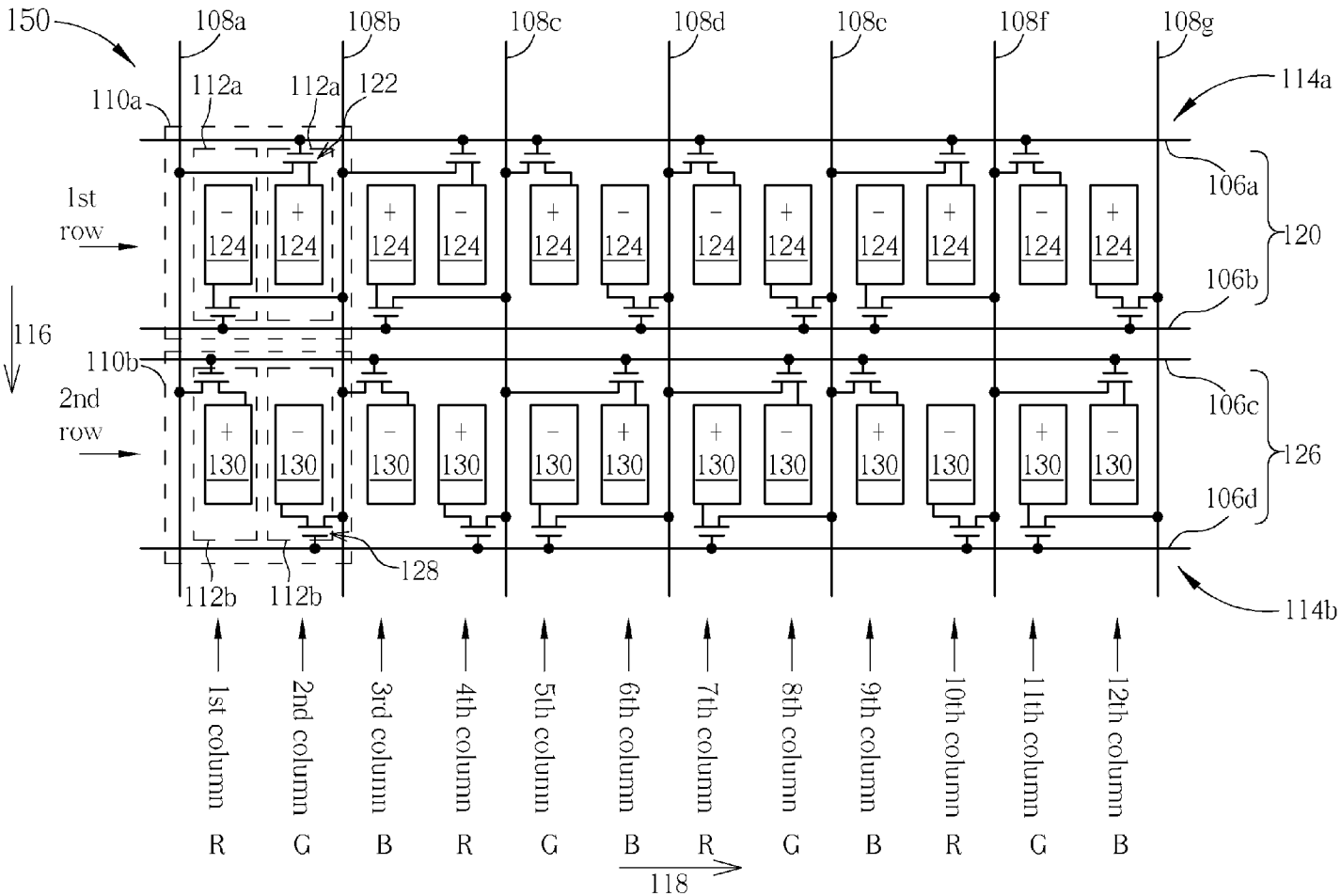
FIG. 7 is a schematic diagram illustrating a display panel according to a second embodiment of the present invention.

Referring to FIG. 7, which is a schematic diagram illustrating a display panel according to a second embodiment of the present invention. As shown in FIG. 7, as compared with the first embodiment, each of the second sub-pixels 112*b* disposed in the 2nd row and the corresponding first sub-pixel 112*a* disposed in the same column of the display panel 150 of this embodiment have the polarities opposite to each other. That is, the second sub-pixel unit 114*b* and the first sub-pixel unit 114*a* have the polarity arrangements opposite to each other. The first sub-pixel unit 114*a* of this embodiment has the same polarity arrangement as the first sub-pixel unit of the first embodiment.

In the first scanning time of the display panel 150, the first sub-pixels 112*a* disposed at the 1st row and the 2nd column, the 3rd column, the 5th column, the 8th column, the 10th column, and the 12th column have the first polarity, and the first sub-pixels 112*a* disposed at the 1st row and the 1st column, the 4th column, the 6th column, the 7th column, the 9th column, and the 11th column have the second polarity. In the second scanning time of the display panel 150, the second sub-pixels 112*b* disposed at the 2nd row and the 1st column, the 4th column, the 6th column, the 7th column, the 9th column, and the 11th column have the third polarity, and the second sub-pixels 112*b* disposed at the 2nd row and the 2nd column, the 3rd column, the 5th column, the 8th column, the 10th column, and the 12th column have the fourth polarity. The third polarity is opposite to the fourth polarity, and the third polarity is the same as the first polarity. The fourth polarity is the same as the second polarity. Thus, the polarity arrangement of the first sub-pixel unit 114*a* arranged sequentially from left to right is "−++−+−−+−+−+", and the polarity arrangement of the second sub-pixel unit 114*b* arranged sequentially from left to right is "+−−+−++−+−+−". It is worthy to note that this embodiment can generate an effect of the dot inversion because the first sub-pixels 112*a* and the second sub-pixels 112*b* disposed in the adjacent rows have opposite polarities.

In order to detail the connection of the sub-pixels in a sub-pixel unit, refer to FIG. 7. The connection structure of the second sub-pixels 112*b* of the second sub-pixel unit 114*b* in the following description is only an example of the second sub-pixel unit 114*b* having the polarity arrangement of "+−−+−++−+−+−", but the present invention is not limited to this example. In other examples, the connection structure of each second sub-pixel 112*b* in the second sub-pixel unit 114*b* can be correspondingly adjusted according to the number of the second sub-pixels 112*b* included by each second pixel 110*b* or the arranged shape of each second sub-pixel 112*b*. The second sub-pixel unit 114*b* mainly has the polarity arrangement of "+−−+−++−+−+−". In this embodiment, the gate electrodes of the second switching elements 128 respectively disposed at the 2nd row and the 1st column, the 3rd column, the 6th column, the 8th column, the 9th column and the 12th column are coupled to the 1st second gate line 106*c*; the gate electrodes of the second switching elements 128 respectively disposed at the 2nd row and the 2nd column, the 4th column, the 5th column, the 7th column, the 10th column and the 11th column are coupled to the 2nd second gate line 106*d*; the source electrode of the second switching element 128 disposed at the 2nd row and the 1st column is coupled to the 1st data line 108*a*; the source electrodes of the second switching elements 128 disposed at the 2nd row and the 2nd column and the 3rd column are coupled to the 2nd data line 108*b*; the source electrodes of the second switching elements 128 disposed at the 2nd row and the 4th column and the 6th column are coupled to the 3rd data line 108*c*; the source electrodes of the second switching elements 128 disposed at the 2nd row and the 5th column and the 8th column are coupled to the 4th data line 108*d*; the source electrodes of the second switching elements 128 disposed at the 2nd row and the 7th column and the 9th column are coupled to the 5th data line 108*e*; the source electrodes of the second switching elements 128 disposed at the 2nd row and the 10th column and the 12th column are coupled to the 6th data line 108*f*; the source electrode of the second switching element 128 disposed at the 2nd row and the 11th column is coupled to the 7th data line 108*g*. When the display panel 150 of this embodiment uses the same column inversion driving method as that of the first embodiment, the polarity arrangement of the first sub-pixel unit 114*a* from left to right is "−++−+−−+−+−+", and the polarity arrangement of the second sub-pixel unit 114*b* from left to right is "+−−+−++−+−+−". Thus, as compared with the first embodiment, the display panel 150 of this embodiment can use the column inversion driving method to achieve an effect of the polarity arrangement of the pixel structure having dot inversion.

Figure 8:
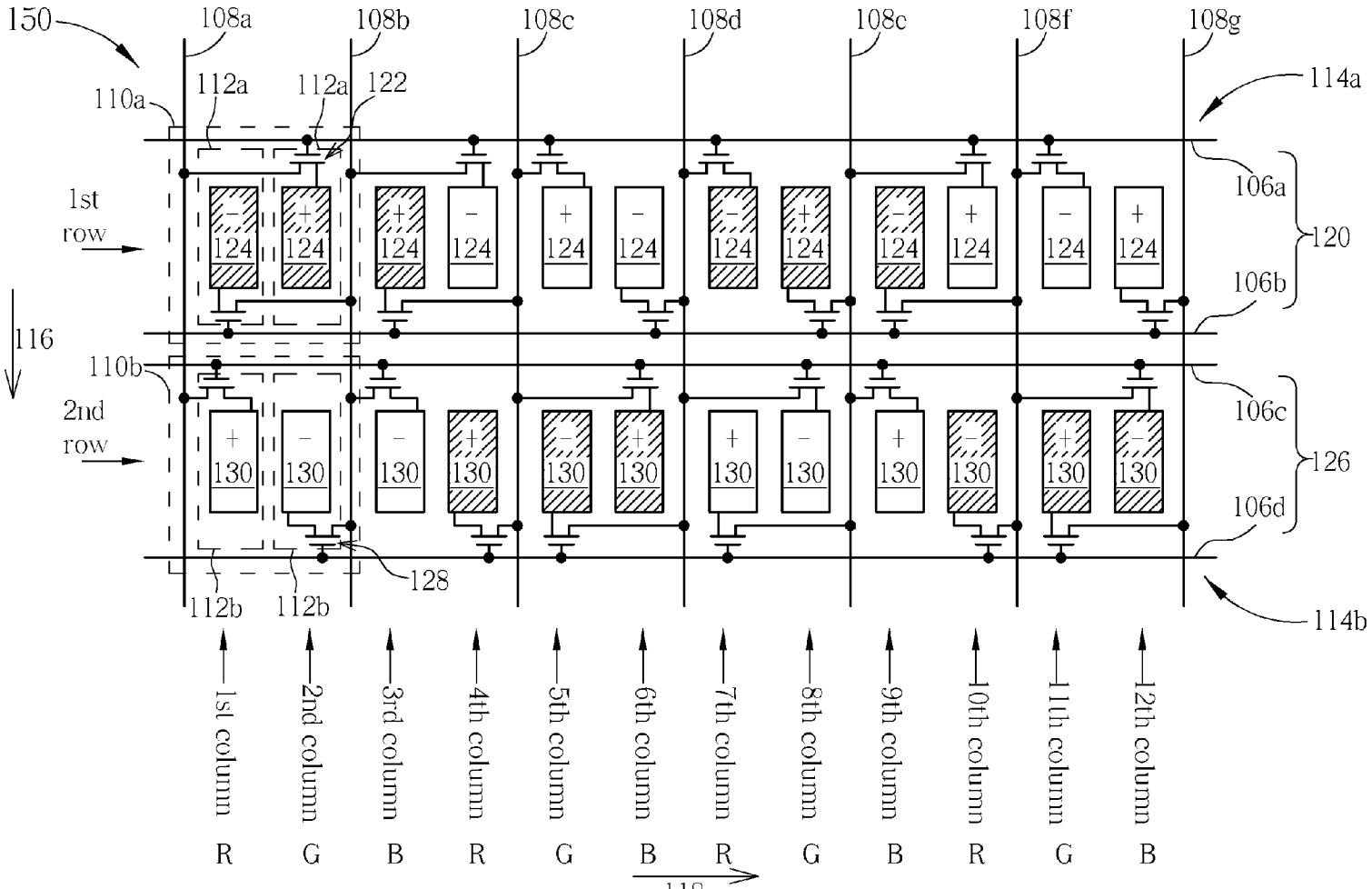
FIG. 8 is a schematic diagram illustrating the polarity arrangement of the display panel during testing according to the second embodiment of the present invention.

For clarify the display panel of this embodiment having the balance polarity during testing, refer to FIG. 8, which is a schematic diagram illustrating the polarity arrangement of the display panel during testing according to the second embodiment of the present invention. As shown in FIG. 8, the display panel 150 uses the column inversion driving method to be tested. Because the polarity arrangement of the first sub-pixel unit 114*a* in this embodiment is the same as that of the first embodiment, the testing pattern of the first sub-pixel unit 114*a* in this embodiment is the same as the testing pattern in the first embodiment, and is not detailed redundantly. In the second sub-pixel unit 114*b*, the second sub-pixels 112*b* disposed in the 4th column, the 5th column, the 6th column, the 10th column, the 11th column and the 12th column are turned off, and the second sub-pixels 112*b* disposed in the 1st column, the 2nd column, the 3rd column, the 7th column, the 8th column and the 9th column are turned on. Thus, the second sub-pixels 112*b* disposed in the 1st column, the 7th column and the 9th column have the third polarity, and the second sub-pixels 112*b* disposed in the 2nd column, the 3rd column and the 8th column have the fourth polarity. As we can see from the above, a half of the second sub-pixels 112*b*, which are turned on, have the third polarity, and the other half of the second sub-pixels 112*b*, which are turned on, have the fourth polarity. Therefore, the second sub-pixel unit 114*b* can have the balance polarity during testing so as to avoid the greenish image or color shift.

Figure 9:
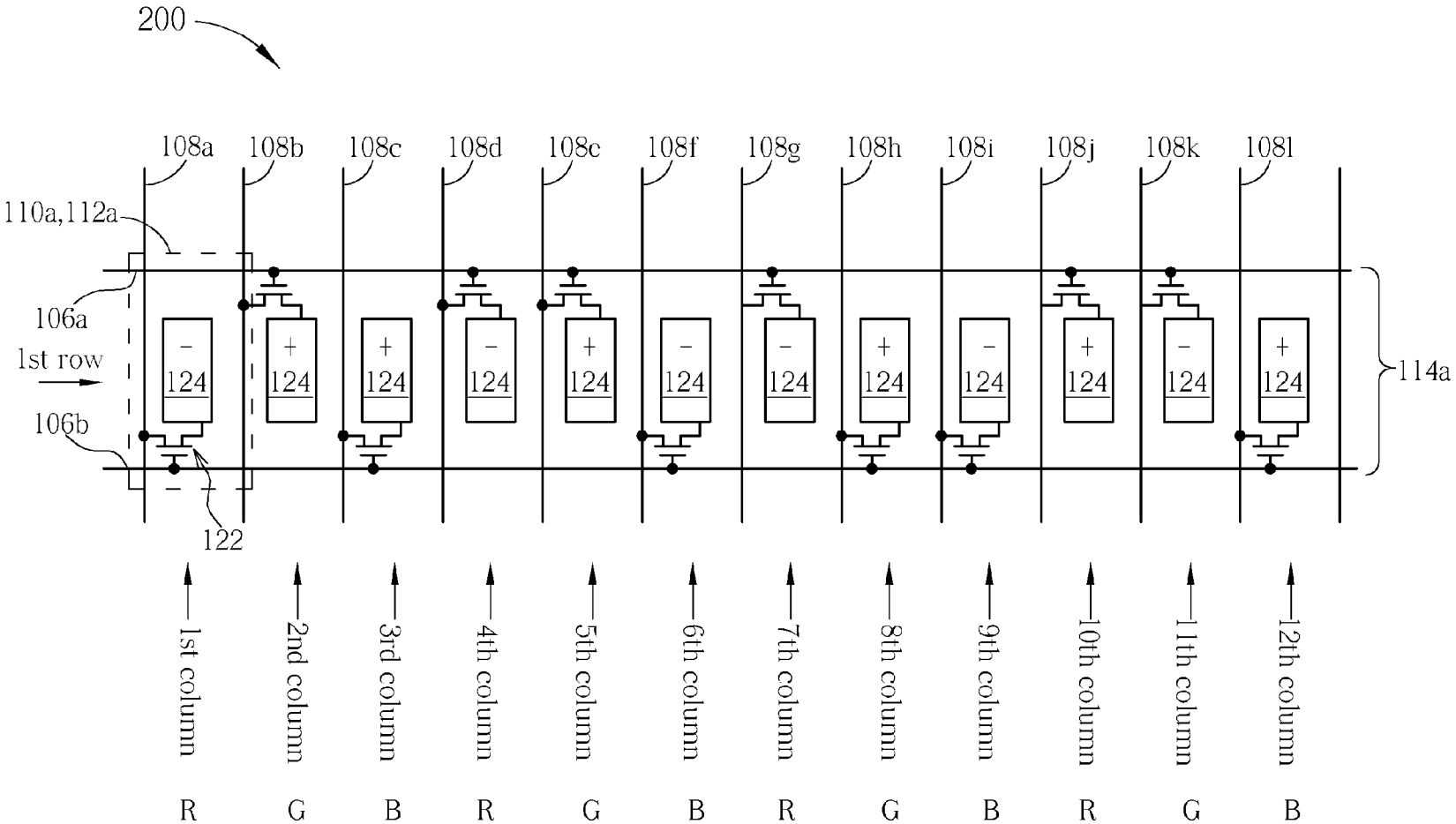
FIG. 9 is a schematic diagram illustrating a first sub-pixel unit of a display panel according to a third embodiment of the present invention.

Referring to FIG. 9, which is a schematic diagram illustrating a first sub-pixel unit of a display panel according to a third embodiment of the present invention. As shown in FIG. 9, as compared with the first embodiment, the first gate-line set 120 and any two of the adjacent data lines 108 of the display panel 200 in this embodiment only define a first sub-pixel 112*a*, and each first sub-pixel 112*a* is defined as a first pixel 110*a*. Thus, the first sub-pixel unit 114*a* has twelve first pixels 110*a*. In this embodiment, the data lines 108 further includes an 8th data line 108*h*, a 9th data line 108*i*, a 10th data line 108*j*, an 11th data line 108*k* and a 12th data line 1081, and the polarity arrangement of the first sub-pixels 112*a* in this embodiment is the same as the polarity arrangement of the first sub-pixel unit 114*a* in the first embodiment; that is, "−++−+−−+−+−+".

In order to detail the connection of the sub-pixels in a sub-pixel unit, refer to FIG. 9 again. The connection structure of the first sub-pixels 112*a* of the first sub-pixel unit 114*a* in the following description is only an example of the first sub-pixel unit 114*a* having the polarity arrangement of "−++−+−−+−+−+", but the present invention is not limited to this example. In other examples, the connection structure of each first sub-pixel 112*a* of the first sub-pixel unit 114*a* can be correspondingly adjusted according to the number of the first sub-pixels 112*b* included by each first pixel 110*a*, such as each first pixel 110*a* including three first sub-pixels 112*a*, or the arranged shape of each first sub-pixel 112*a*, such as triangle arrangement. The second sub-pixel unit 114*b* mainly has the polarity arrangement of "−++−+−−+−+−+". In this embodiment, the source electrode of each first switching element 122 of each first sub-pixel 112*a* is respectively coupled to a data line 108 disposed at a left side thereof; that is, the source electrode of the first switching element 122 disposed in the 1st row is coupled to the 1st data line 108*a*, and so on. It is worthy to note that this embodiment also uses the column inversion driving method, but the polarity arrangement provided to the data lines 108 in this embodiment is different from that of the first embodiment and the second embodiment. The data-line driving circuit 104 transfers the data signals with the first polarity to the 2nd data line 108*b*, the 3rd data line 108*c*, the 5th data line 108*e*, the 8th data line 108*h*, the 10th data line 108*j* and the 12th data line 1081, so that the first sub-pixels 112*a* disposed in the 2nd column, the 3rd column, the 5th column, the 8th column, the 10th column and the 12th column have the first polarity. Furthermore, the data-line driving circuit 104 also transfers the data signals with the second polarity to the 1st data line 108*a*, the 4th data line 108*d*, the 6th data line 108*f*, the 7th data line 108*g*, the 9th data line 108*i* and the 11th data line 108*k*, so that the first sub-pixels 112*a* disposed in the 1st column, the 4th column, the 6th column, the 7th column, the 9th column and the 11th column have the first polarity. The first polarity is opposite to the second polarity. Therefore, the polarity arrangement of the first sub-pixel unit 114*a* in this embodiment is the same as that in the first embodiment; that is, "−++−+−−+−+−+".

Figure 10:
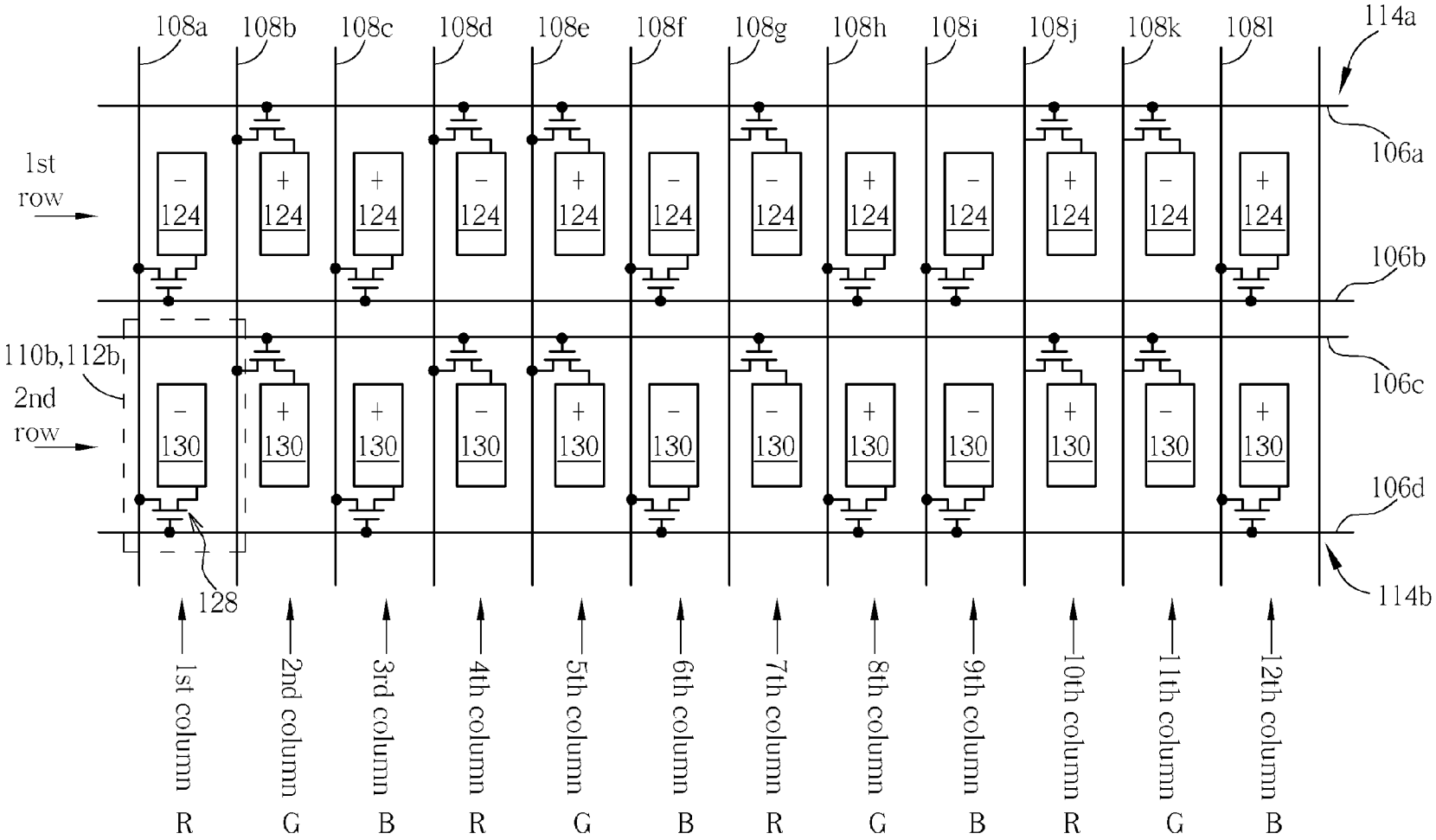
FIG. 10 is a schematic diagram illustrating the display panel having the repeated first sub-pixel units disposed in different rows according to the third embodiment of the present invention.

In addition, this embodiment also can repeat the first sub-pixel unit in the same row or in different rows. Referring to FIG. 10, which is a schematic diagram illustrating the display panel having the repeated first sub-pixel units disposed in different rows according to the third embodiment of the present invention. As shown in FIG. 10, the second sub-pixel unit 114*b* and the first sub-pixel unit 114*a* have the same electrical connection and the polarity arrangement.

Figure 11:
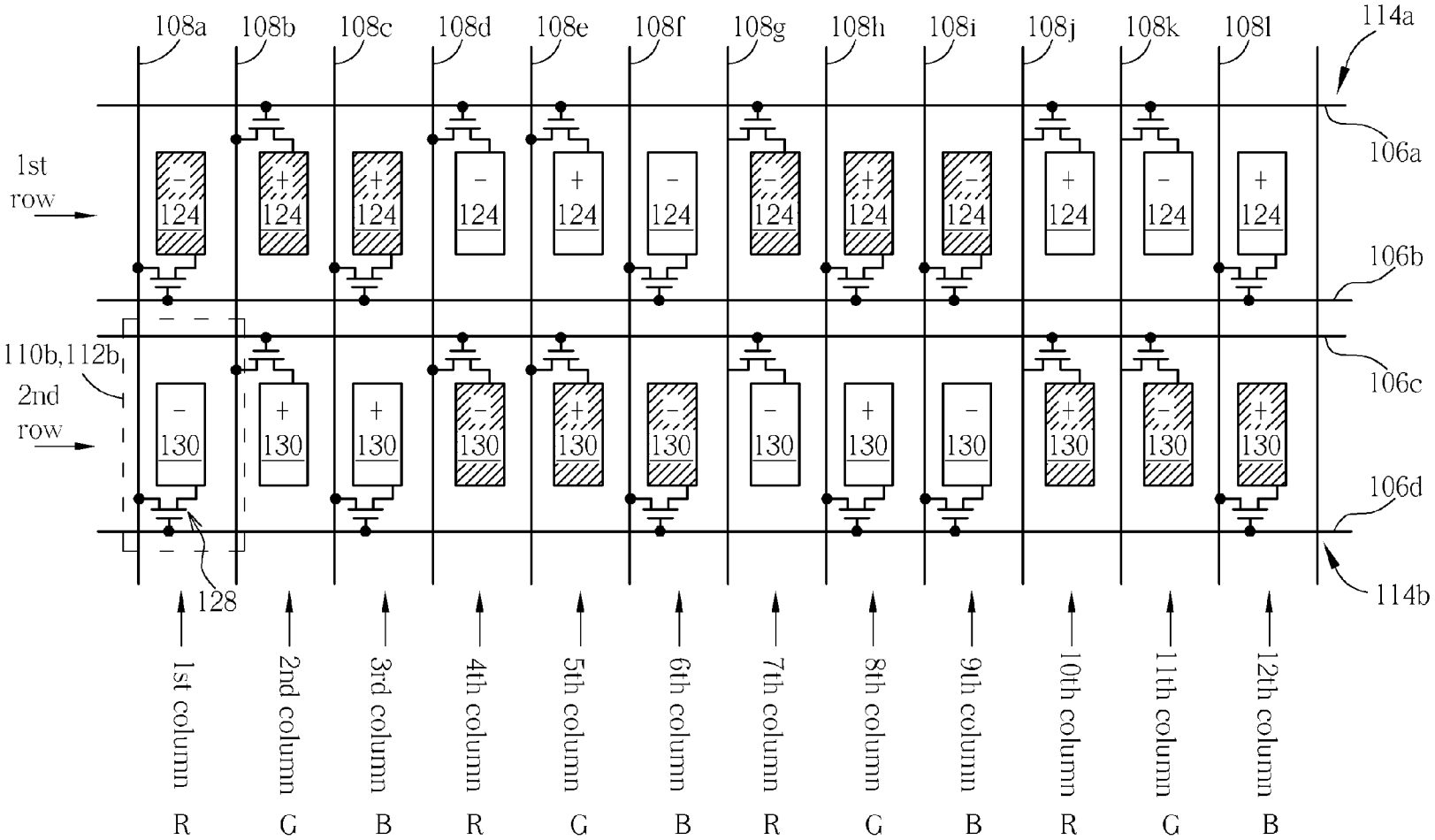
FIG. 11 is a schematic diagram illustrating the polarity arrangement of the display panel during testing according to the third embodiment of the present invention.

Referring to FIG. 11, which is a schematic diagram illustrating the polarity arrangement of the display panel during testing according to the third embodiment of the present invention. As shown in FIG. 11, because the first sub-pixel unit 114*a* and the second sub-pixel unit 114*b* in this embodiment have the same polarity arrangement as that of the first sub-pixel unit of the first embodiment, the first sub-pixels 112*a* disposed in the 5th column, the 10th column and the 12th column have the first polarity, and the first sub-pixels 112*a* disposed in the 4th column, the 6th column and the 11th column have the second polarity during testing. In addition, the second sub-pixels 112*b* disposed in the 2nd column, the 3rd column and the 8th column have the third polarity, and the second sub-pixels 112*b* disposed in the 1st column, the 7th column and the 9th column have fourth polarity. Accordingly, in this embodiment, a half of the first sub-pixels 112*a* and a half of the second sub-pixels 112*b*, which are turned on, have the same polarity, and the other half of the first sub-pixels 112*a* and the other half of the second sub-pixels 112*b*, which are turned on, have the same polarity. Therefore, the display panel 200 of this embodiment can have the balance polarity during testing so as to avoid greenish image or color shift.

Figure 12:
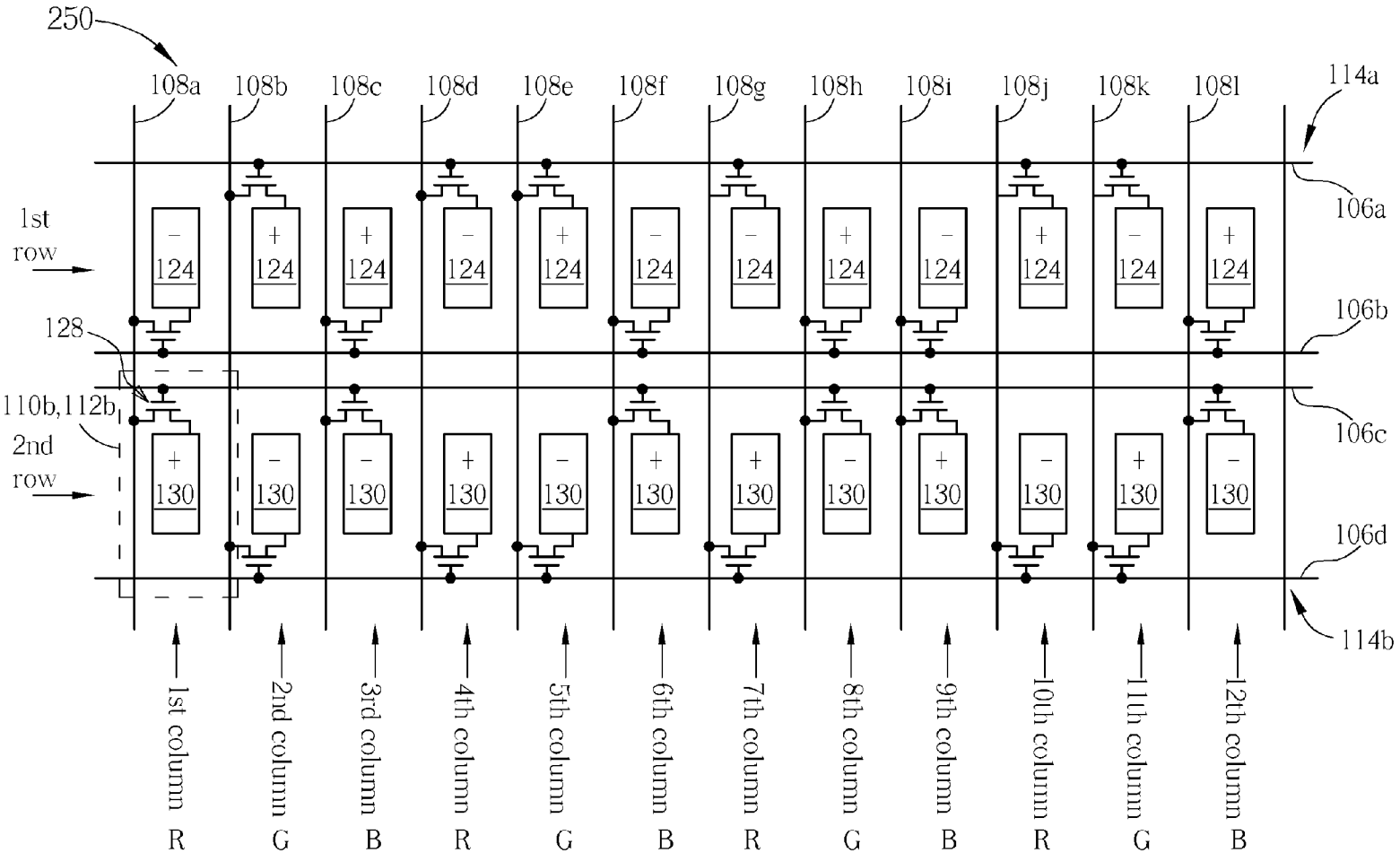
FIG. 12 is a schematic diagram illustrating a first sub-pixel unit and a second sub-pixel unit of a display panel according to a fourth embodiment of the present invention.

Referring to FIG. 12, which is a schematic diagram illustrating a first sub-pixel unit and a second sub-pixel unit of a display panel according to a fourth embodiment of the present invention. As shown in FIG. 12, as compared with the third embodiment, each second sub-pixel 112*b* disposed in the 2nd row and the corresponding first sub-pixel 112*a* disposed in the same column of the display panel 250 of this embodiment have the polarities opposite to each other. Thus, the second sub-pixels 112*b* disposed at the 2nd row and the 1st column, the 4th column, the 6th column, the 7th column, the 9th column and the 11th column have the first polarity, and the second sub-pixels 112*b* disposed at the 2nd row and the 2nd column, the 3rd column, the 5th column, the 8th column, the 10th column and the 12th column have the fourth polarity. The third polarity is opposite to the fourth polarity, and the third polarity is the same as the first polarity. The fourth polarity is the same as the second polarity. Thus, the polarity arrangement of the first sub-pixel unit 114*a* from left to right is "−++−+−−+−+−+", and the polarity arrangement of the second sub-pixel unit 114*b* from left to right is "+−−+−++−+−+−". This embodiment also can uses the dot inversion driving method to enable the first sub-pixel unit 114*a* in the 1st row to have the same polarity arrangement as that of the second sub-pixel unit 114*b* in the 2nd row, but the present invention is not limited to this embodiment.

Figure 13:
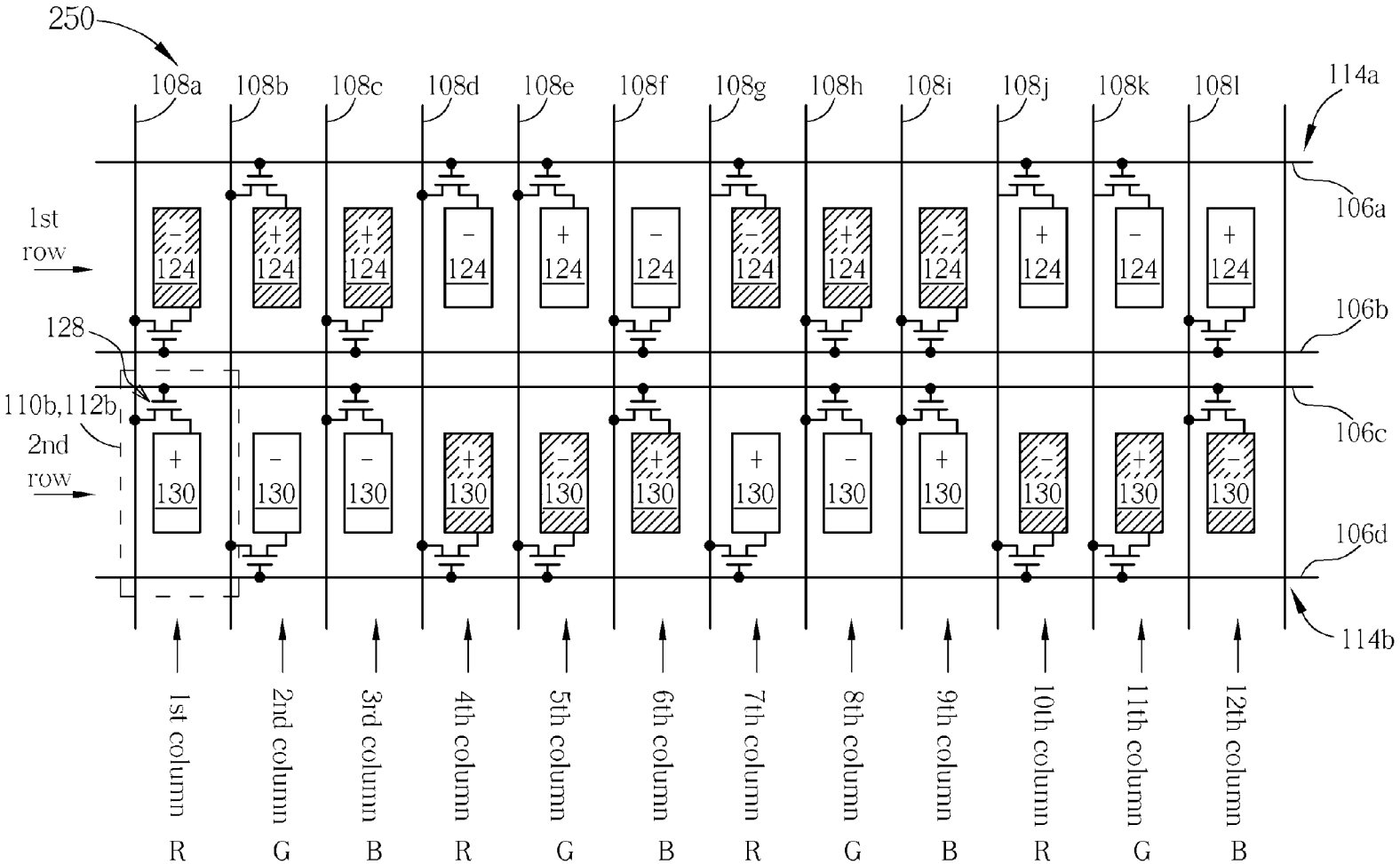
FIG. 13 is a schematic diagram illustrating the polarity arrangement of the display panel during testing according to the fourth embodiment of the present invention

Referring to FIG. 13, which is a schematic diagram illustrating the polarity arrangement of the display panel during testing according to the fourth embodiment of the present invention. As shown in FIG. 13, because the first sub-pixel unit 114*a* of this embodiment has the same polarity arrangement as that of the first sub-pixel unit 114*a* of the second embodiment, and the second sub-pixel unit 114*b* of this embodiment has the same polarity arrangement as the second sub-pixel unit 114*b* of the second embodiment, a half of the first sub-pixels 112*a* and a half of the second sub-pixels 112*b*, which are turned on, have the same polarity, and the other half of the first sub-pixels 112*a* and the other half of the second sub-pixels, which are turned on, have the same polarity during testing. Therefore, the display panel 250 of this embodiment can have the balance polarity during testing.

In summary, the present invention provides the sub-pixel unit with the above-mentioned polarity arrangement, and repeats the sub-pixel unit to form the pixel array, so that the display panel can have the balance polarity during testing so as to avoid failure resulted from the greenish image or color shift. In addition, the data-line driving circuit of the provided display panel in the present invention does not need the inverter, and the display panel can only use the column inversion driving method in the prior art to have the effect of the balance polarity.

Those skilled in the art will readily observe that numerous modifications and alterations of the device and method may be made while retaining the teachings of the invention.

What is claimed is:

1. A display panel, comprising:

a plurality of first gate lines, comprising a 1st first gate line, and a 2nd first gate line, and the 1st first gate line and the 2nd first gate line arranged sequentially in a first direction;

a plurality of data lines, comprising a 1st data line, a 2nd data line, a 3rd data line, a 4th data line, a 5th data line, a 6th data line, and a 7th data line, arranged sequentially in a second direction, and the second direction intersecting the first direction; and at least six first pixels, respectively defined by any two of the adjacent first gate lines and any two of the adjacent data lines, each first pixel comprising two first sub-pixels, the first sub-pixels being arranged in a 1st row, and each first sub-pixel comprising a first switching element;

wherein a gate electrode of the first switching element respectively disposed at the 1st row and a 2nd column, a 4th column, a 5th column, a 7th column, a 10th column and an 11th column are coupled to the 1st first gate line;

the gate electrode of the first switching element respectively disposed at the 1st row and a 1st column, a 3rd column, a 6th column, an 8th column, a 9th column and a 12th column are coupled to the 2nd first gate line;

a source electrode of the first switching element disposed at the 1st row and the 2nd column is coupled to the 1st data line;

the source electrode of the first switching element disposed at the 1st row and the 1st column and the 4th column are coupled to the 2nd data line;

the source electrode of the first switching element disposed at the 1st row and the 3rd column and the 5th column are coupled to the 3rd data line;

the source electrode of the first switching element disposed at the 1st row and the 6th column and the 7th column are coupled to the 4th data line;

the source electrodes of the first switching element disposed at the 1st row and the 8th column and the 10th column are coupled to the 5th data line;

the source electrode of the first switching element disposed at the 1st row and the 9th column and the 11th column are coupled to the 6th data line;

the source electrode of the first switching element disposed at the 1st row and the 12th column is coupled to the 7th data line.

2. The display panel of claim 1, wherein in a first scanning time of the display panel, the first sub-pixels disposed at the 1st row and the 2nd column, the 3rd column, the 5th column, the 8th column, the 10th column and the 12th column have a first polarity, the first sub-pixels disposed at the 1st row and the 1st column, the 4th column, the 6th column, the 7th column, the 9th column and the 11th column have a second polarity, and the first polarity is opposite to the second polarity.

3. The display panel of claim 1, further comprising:

a plurality of second gate lines, comprising a 1st second gate line and a 2nd second gate line, arranged sequentially in the first direction; and at least six second pixels, respectively defined by any two of the second gate lines and any two of the data lines, each second pixel respectively comprising two second sub-pixels, the second sub-pixels being arranged sequentially in a 2nd row adjacent to the 1st row, and each second sub-pixel comprising a second switching element;

wherein a gate electrode of the second switching element respectively disposed at the 2nd row and the 2nd column, the 4th column, the 5th column, the 7th column, the 10th column and the 11th column are coupled to the 1st second gate line;

the gate electrode of the second switching element respectively disposed at the 2nd row and the 1st column, the 3rd column, the 6th column, the 8th column, the 9th column and the 12th column are coupled to the 2nd second gate line;

a source electrode of the second switching element disposed at the 2nd row and the 2nd column is coupled to the 1st data line;

the source electrode of the second switching element disposed at the 2nd row and the 1st column and the 4th column are coupled to the 2nd data line;

the source electrode of the second switching element disposed at the 2nd row and the 3rd column and the 5th column are coupled to the 3rd data line;

the source electrode of the second switching element disposed at the 2nd row and the 6th column and the 7th column are coupled to the 4th data line;

the source electrode of the second switching element disposed at the 2nd row and the 8th column and the 10th column are coupled to the 5th data line;

the source electrode of the second switching element disposed at the 2nd row and the 9th column and the 11th column are coupled to the 6th data line;

the source electrode of the second switching element disposed at the 2nd row and the 12th column is coupled to the 7th data line.

4. The display panel of claim 3, wherein in a first scanning time of the display panel, the first sub-pixels disposed at the 1st row and the 2nd column, the 3rd column, the 5th column, the 8th column, the 10th column and the 12th column have a first polarity, and the first sub-pixels disposed at the 1st row and the 1st column, the 4th column, the 6th column, the 7th column, the 9th column and the 11th column have a second polarity; in a second scanning time of the display panel, the second sub-pixels disposed at the 2nd row and the 1st column, the 4th column, the 6th column, the 7th column, the 9th column and the 11th column have a third polarity, and the second sub-pixels disposed at the 2nd row and the 2nd column, the 3rd column, the 5th column, the 8th column, the 10th column and the 12th column have a fourth polarity, wherein the third polarity is opposite to the fourth polarity, the third polarity is the same as the second polarity, and the fourth polarity is the same as the first polarity.

5. The display panel of claim 1, further comprising:

a plurality of second gate lines, comprising a 1st second gate line and a 2nd second gate line, arranged sequentially in the first direction; and at least six second pixels, respectively defined by any two of the second gate lines and any two of the data lines, each second pixel respectively comprising two second sub-pixels, the second sub-pixels being arranged sequentially in a 2nd row adjacent to the 1st row, and each second sub-pixel comprising a second switching element;

wherein the gate electrodes of the second switching element respectively disposed at the 2nd row and the 1st column, the 3rd column, the 6th column, the 8th column, the 9th column and the 12th column are coupled to the 1st second gate line;

the gate electrode of the second switching element respectively disposed at the 1st row and the 2nd column, the 4th column, the 5th column, the 7th column, the 10th column and the 11th column are coupled to the 2nd second gate line;

the source electrode of the second switching element disposed at the 2nd row and the 1st column is coupled to the 1st data line;

the source electrode of the second switching element disposed at the 2nd row and the 2nd column and the 3rd column are coupled to the 2nd data line;

the source electrode of the second switching element disposed at the 2nd row and the 4th column and the 6th column are coupled to the 3rd data line;

the source electrode of the second switching element disposed at the 2nd row and the 5th column and the 8th column are coupled to the 4th data line;

the source electrode of the second switching element disposed at the 2nd row and the 7th column and the 9th column are coupled to the 5th data line;

the source electrode of the second switching element disposed at the 2nd row and the 10th column and the 12th column are coupled to the 6th data line;

the source electrode of the second switching element disposed at the 2nd row and the 11th column is coupled to the 7th data line.

6. The display panel of claim 5, wherein in a first scanning time of the display panel, the first sub-pixels disposed at the 1st row and the 2nd column, the 3rd column, the 5th column, the 8th column, the 10th column and the 12th column have a first polarity, and the first sub-pixels disposed at the 1st row and the 1st column, the 4th column, the 6th column, the 7th column, the 9th column and the 11th column have a second polarity; in a second scanning time of the display panel, the second sub-pixels disposed at the 2nd row and the 1st column, the 4th column, the 6th column, the 7th column, the 9th column and the 11th column have a third polarity, and the second sub-pixels disposed at the 2nd row and the 2nd column, the 3rd column, the 5th column, the 8th column, the 10th column and the 12th column have a fourth polarity, wherein the third polarity is opposite to the fourth polarity, the third polarity is the same as the first polarity, and the fourth polarity is the same as the second polarity.

7. The display panel of claim 1, wherein the display panel further comprising at least one data-line driving circuit, coupled to the data lines, and the data-line driving circuit does not have an inverter.

8. A display panel, comprising:

at least twelve first sub-pixels, arranged continuously in a 1st row, wherein in a first scanning time of the display panel, the first sub-pixels disposed at the 1st row and the 2nd column, the 3rd column, the 5th column, the 8th column, the 10th column and the 12th column have a first polarity, the first sub-pixels disposed at the 1st row and the 1st column, the 4th column, the 6th column, the 7th column, the 9th column and the 11th column have a second polarity, and the first polarity is opposite to the second polarity, wherein the 1st column, the 2nd column, 3rd column, the 4th column, the 5th column, the 6th column, the 7th column, the 8th column, the 9th column, the 10th column, the 11th column, and the 12th column are sequentially arranged along the 1st row.

9. The display panel of claim 8, further comprising at least twelve second sub-pixels, arranged continuously in a 2nd row, wherein a polarity arrangement of the twelve second sub-pixels in the 2nd row is the same as a polarity arrangement of the twelve first sub-pixels in the 1st row.

10. The display panel of claim 8, further comprising at least twelve second sub-pixels, arranged continuously in a 2nd row, wherein in a second scanning time of the display panel, the second sub-pixels disposed at the 2nd row and the 1st column, the 4th column, the 6th column, the 7th column, the 9th column and the 11th column have a third polarity, and the second sub-pixels disposed at the 2nd row and the 2nd column, the 3rd column, the 5th column, the 8th column, the 10th column and the 12th column have a fourth polarity, wherein the third polarity is opposite to the fourth polarity, the third polarity is the same as the first polarity, and the fourth polarity is the same as the second polarity.

11. The display panel of claim 8, wherein two adjacent first sub-pixels in the twelve first sub-pixels are defined as a first pixel, and the twelve first sub-pixels have six first pixels.

12. The display panel of claim 8, wherein each of the twelve first sub-pixels is defined as a first pixel, and the twelve first sub-pixels have twelve first pixels.

13. The display panel of claim 8, wherein the display panel further comprising at least one data-line driving circuit, coupled to the first sub-pixels, and the data-line driving circuit does not have an inverter.

* * * * *